US006502274B1

(12) United States Patent
Harrelson, II

(10) Patent No.: US 6,502,274 B1
(45) Date of Patent: Jan. 7, 2003

(54) VACUUM CLEANER BAG MOUNTING ASSEMBLY

(75) Inventor: Clyde W. Harrelson, II, Burgaw, NC (US)

(73) Assignee: Vacs America, Inc., Burgaw, NC (US)

( * ) Notice: Subject to any disclaimer, the term of this patent is extended or adjusted under 35 U.S.C. 154(b) by 0 days.

(21) Appl. No.: 09/773,827

(22) Filed: Jan. 31, 2001

(51) Int. Cl.[7] ..... A47L 5/38

(52) U.S. Cl. ..... 15/314; 15/315; 15/323; 15/352; 55/DIG. 3; 55/373

(58) Field of Search ..... 15/347, 350, 352, 15/314, 323, 315; 55/DIG. 3, 369, 373, 478

(56) References Cited

U.S. PATENT DOCUMENTS

| | | | | | |
|---|---|---|---|---|---|
| 3,023,447 | A | | 3/1962 | Senne | |
| 3,066,345 | A | * | 12/1962 | Kasper | 55/478 |
| 3,213,480 | A | | 10/1965 | Miller | |
| 3,422,482 | A | | 1/1969 | Hamrick | |
| 3,568,239 | A | | 3/1971 | Hamrick | |
| 3,706,184 | A | | 12/1972 | Tucker | |
| 3,714,765 | A | | 2/1973 | Simonelli | |
| 4,452,618 | A | * | 6/1984 | Kuplas | 15/323 |
| 4,670,937 | A | | 6/1987 | Sumerau et al. | |
| 4,678,486 | A | | 7/1987 | Jacob et al. | |
| 4,699,641 | A | * | 10/1987 | Barnes, Jr. | 15/352 |
| 4,885,013 | A | | 12/1989 | Ahlf et al. | |
| 5,020,186 | A | * | 6/1991 | Lessig et al. | 15/339 |
| 5,028,245 | A | * | 7/1991 | Stein et al. | 15/350 |
| 5,089,038 | A | | 2/1992 | Kopco et al. | |
| 5,221,303 | A | | 6/1993 | Guhne et al. | |
| 5,544,385 | A | | 8/1996 | Jailor et al. | |
| 5,740,581 | A | * | 4/1998 | Harrelson, II | 15/314 |
| 5,740,582 | A | * | 4/1998 | Harrelson, II | 15/314 |
| 5,755,009 | A | | 5/1998 | Stephens et al. | |
| 5,935,280 | A | | 8/1999 | Lee | |
| 5,970,575 | A | * | 10/1999 | Lee | 15/350 |
| 6,158,080 | A | | 12/2000 | Schlapkohl | |
| 6,427,284 | B1 | * | 8/2002 | Harrelson, II et al. | 15/315 |

* cited by examiner

*Primary Examiner*—Theresa T. Snider
(74) *Attorney, Agent, or Firm*—MacCord Mason PLLC

(57) ABSTRACT

A vacuum cleaner bag mounting assembly for a stationary vacuum cleaner is described that includes a disposable bag housing that includes an open-front enclosure having a conduit connector wall; a hose connection conduit extending inwardly through the connector wall, a debris collection bag holder having a bag attachment wall and being pivotally mounted at one of the front edges of the compartment between a closed position and an open position; a spring urging the bag holder to its open position; and a door pivotally attached at a front edge of said enclosure and having an open position and a closed position, the door engaging the bag holder when moved from the open position to the closed position to move the bag holder from its open position to its closed position.

12 Claims, 3 Drawing Sheets

VACUUM CLEANER BAG MOUNTING ASSEMBLY

BACKGROUND OF THE INVENTION (1) Field of the Invention

The present invention relates generally to an assembly for holding a disposable bag in an in-wall or other stationary vacuum cleaner, and in particular to a vacuum cleaner bag mounting assembly forming a part of a stationary vacuum cleaner that facilitates attachment and removal of disposable vacuum cleaner bags.

(2) Description of the Prior Art

Vacuum cleaners used to remove debris within a house or other building are generally comprised of a flexible hose with a distal inlet end and a proximal outlet end, a vacuum source to draw air through the hose, and a debris collector interposed between the hose and the vacuum source to collect debris carried in the air exiting from the hose outlet end. Vacuum cleaners have historically been of two designs. So-called portable vacuum cleaners are designed to be carried or rolled about the area to be vacuumed, and usually include a bag or canister to enclose an air permeable, disposable bag designed to be removably attached to the outlet end of a conduit that is in communication with a flexible hose or other debris collection device.

Stationary or central vacuum cleaners are generally comprised of a vacuum source and debris collector installed in a remote location within the building, with conduits extending from the remote location to various areas requiring vacuuming. When used, a flexible hose is attached to one of the outlets and the vacuum source drawing air and any collected debris through the flexible hose and conduit. The air is then conveyed through the debris collector for removal of debris before the air is discharged to the exterior.

More recent innovations include the development of in-wall or free standing vacuum cleaners such as described in U.S. Pat. Nos. 5,740,581 and 5,740,582 to Harrelson, II, both issued Apr. 21, 1998, assigned to the assignee of this invention, and incorporated herein by reference. These patents describe an in-wall system with a cabinet having one compartment to enclose a vacuum unit and a debris collector, and a hose storage compartment that includes a reversible drive unit for extending and retracting the hose. The upper area of the cabinet includes a door for access to a hose nozzle connected to the distal end of the flexible hose, which has its proximal end connected to the vacuum unit. Another door in the lower part of the cabinet provides access to the debris collector. The cabinet is sized to fit between adjacent wall studs.

When using the device described in the Harrelson, II patents, the user opens the door in the upper part of the cabinet and grasps the hose nozzle, which includes a switch with forward-stop-reverse positions in circuit with the drive unit. The drive unit includes drive rollers that exert pressure on either side of the hose, which extends from its storage compartment between the nip of the drive rollers. When the user moves the switch to the"forward" position, the drive rollers turn to feed the hose outwardly from the cabinet until all of the hose has been extended, or until the switch is moved to the"off" position by the user. After vacuuming, the user moves the witch to"reverse", rotating the rollers in the opposite direction to return the hose to he storage compartment.

The debris collector is comprised of an open-front enclosure with a conduit in communication with the proximal end of the flexible hose extends into the enclosure, The enclosure is also in communication with a vacuum source, which can be within the enclosure, or in communication with the enclosure through a discharge opening in the enclosure wall. A hinged door provides access into the enclosure and forms an airtight seal with the front edges of the enclosure when closed.

The enclosure is sized to receive a disposable vacuum cleaner bag of the type sold for use with portable vacuum cleaners. Generally, these bags are comprised of a bag portion formed of paper or other flexible, air permeable material, and a cover that extends across the bag mouth. The cover includes a conduit opening for receiving the hose conduit. A flexible, annular ring having a diameter slightly less that the diameter of the hose conduit normally surrounds the periphery of the conduit opening to provide a sealing fit with the exterior surface of the hose conduit.

To install a disposable bag, the user opens the door, inserts a bag into the enclosure and pushes bag cover opening around the hose conduit. After the door is closed, the vacuum source can be activated, drawing air from the hose conduit through the bag and out of the enclosure, with any airborne debris being captured in the bag interior. To remove a full bag, the user opens the door and pulls the bag from the hose conduit.

Due to its in-wall placement, the dimensions of the bag enclosure closely approximate the outer dimensions of the flexible bag. In addition, the door providing access into the bag enclosure is often located close to the floor. As a result, placement of the bag can be cumbersome and time consuming. In addition, there is a risk that the bag may not be accurately attached to the conduit, or that the bag may be torn when being removed from the conduit, in either instance resulting in debris spillage. Therefore, a better way to attach and remove the disposable bag would be of great value, and would increase the utility of in-wall and other stationary vacuum cleaners.

SUMMARY OF THE INVENTION

The present invention addresses this need by providing an improved vacuum cleaner bag mounting assembly, and an in-wall vacuum cleaner that incorporates this assembly. Generally, the assembly is comprised of an open-front enclosure with a rear wall and opposed side walls, a top wall and a bottom wall, and a bag holder pivotal within the enclosure between open and closed positions. A hose conduit extends into the enclosure through either the top wall or one of the side walls, the wall through which the conduit extends being referred to herein as the enclosure conduit wall. The assembly also includes a hinged door positionable across the front opening of the enclosure.

The bag holder is adapted to support a disposable bag so that pivoting of the bag holder to the closed position inserts the bag opening over the end of the hose conduit. For example, the holder can include an conduit attachment wall with a hose conduit access opening, and means for attaching a disposable bag beneath the conduit attachment wall so that the bag opening is aligned with the conduit access opening. The conduit attachment wall may be a plate with inner and outer surfaces, with a conduit receiving opening extending between the surfaces.

The conduit attachment wall or plate is hinged at its front edge to the front edge of the enclosure conduit wall. Thus, when the bag holder is in the closed position, the bag attachment wall of the bag holder is parallel to the enclosure conduit wall. When the bag is to be removed, or another bag inserted, the bag holder is pivoted to the open position, which moves the bag opens from contact with the hose conduit. After a bag has been positioned onto the bag holder, the holder is pivoted to the closed position, which pushes the bag opening around the hose conduit.

Preferably, the bag holder also includes side walls to prevent a bag carried in the bag holder from scrubbing against the enclosure when being inserted or removed. The holder may also include bottom and rear walls. One or more of these walls may be perforated to provide unobstructed airflow.

The inner faces of the side walls may be separated at a distance slightly greater that the width of the disposable bag that is to be mounted in the holder, and may include opposed slots parallel to, and spaced slightly below, the attachment plate for slidably receiving the side edges of the bag cover. Partial walls are also contemplated by the invention, as are discontinuous slots.

The enclosure door is desirably hinged to the front edge of the enclosure that is on the opposite side from the front edge to which the attachment plate is hinged. For example, the attachment plate may be hinged to the top front edge of the enclosure, with the door being hinged to the bottom front edge of the enclosure. Alternatively, the enclosure conduit wall can form one of the side walls of the enclosure, with the enclosure door being hinged to the front edge of the opposite side wall.

The bag holder can be moved manually between the open and closed positions, by grasping the holder and pulling or pushing, as the case may be. However, in accordance with the present invention, the device can also include a spring to urge the bag holder to the open position, with the enclosure door moving the bag holder to the closed position, and holding the holder in the closed position, when the door is closed.

For example, the bag holder can be designed so that at least a part of the bag holder engages the inner surface of the door when the bag holder is in the closed position and the door is closed. If the hinge is at the front edge of the enclosure, then a part of the lower front edge, e.g., the front lower comers of the side walls, can be vertically beneath the hinge when the bag attachment wall is parallel to the enclosure conduit wall. In this position, the lower front edge of the bag holder will be restrained from outward movement by the closed door, thereby holding the attachment wall parallel to the conduit wall.

When the door is opened, a part of the front edge of the bag holder is allowed to pivot forward, moving the attachment wall away from the conduit wall, and separating the disposable bag from the hose conduit. Outward movement of the lower edge of the bag holder is facilitated by the use of a spring that is attached to the bag holder to urge the bag holder in an outward direction. For example, a spring may be positioned between the attachment wall and the conduit wall, with the spring being compressed when the bag holder is moved to the closed position.

For example, the bag holder can be designed so that at least a part of the bag holder engages the inner surface of the door when the bag holder is in the closed position and the door is closed. If the hinge is at the front edge of the enclosure, then a part of the lower front edge, e.g., the front lower corners of the side walls, can be vertically beneath the hinge when the bag attachment wall is parallel to the enclosure conduit wall. In this position, the lower front edge of the bag holder will be restrained from outward movement by the closed door, thereby holding the attachment wall parallel to the conduit wall. When the door is opened, the lower edge of the bag holder is allowed to pivot forward, moving the attachment wall away from the conduit wall, and separating the disposable bag from the hose conduit.

In operation, the user opens the enclosure door, which permits the bag holder to pivot to the open position. A bag is inserted into the bag holder, with the top of the bag being secured along the bag attachment wall. The enclosure door is then closed. As the door is closed, the inner surface of the door contacts a front section, e.g., the front lower edge, of the bag holder, pushing the bag holder to the closed position. As the bag holder is moved to the closed position, the mouth or opening of the bag is pushed around the hose conduit, with the flexible member creating a seal with the outer surface of the conduit. Latching of the door holds the bag holder in the closed position.

When the bag is full, the user simply opens the enclosure door. The bag holder, no longer held in the closed position, is urged to the open position by the spring. As the bag holder moves to the open position, the bag mouth is pulled away from the hose conduit. Thus, when the bag holder is in the open position, the user can simply lift the full bag from the holder without danger of spillage.

BRIEF DESCRIPTION OF THE DRAWINGS

The following drawings are for the purpose of illustrating the invention and are not intended to be to scale.

DETAILED DESCRIPTION OF THE INVENTION

Figure 1:
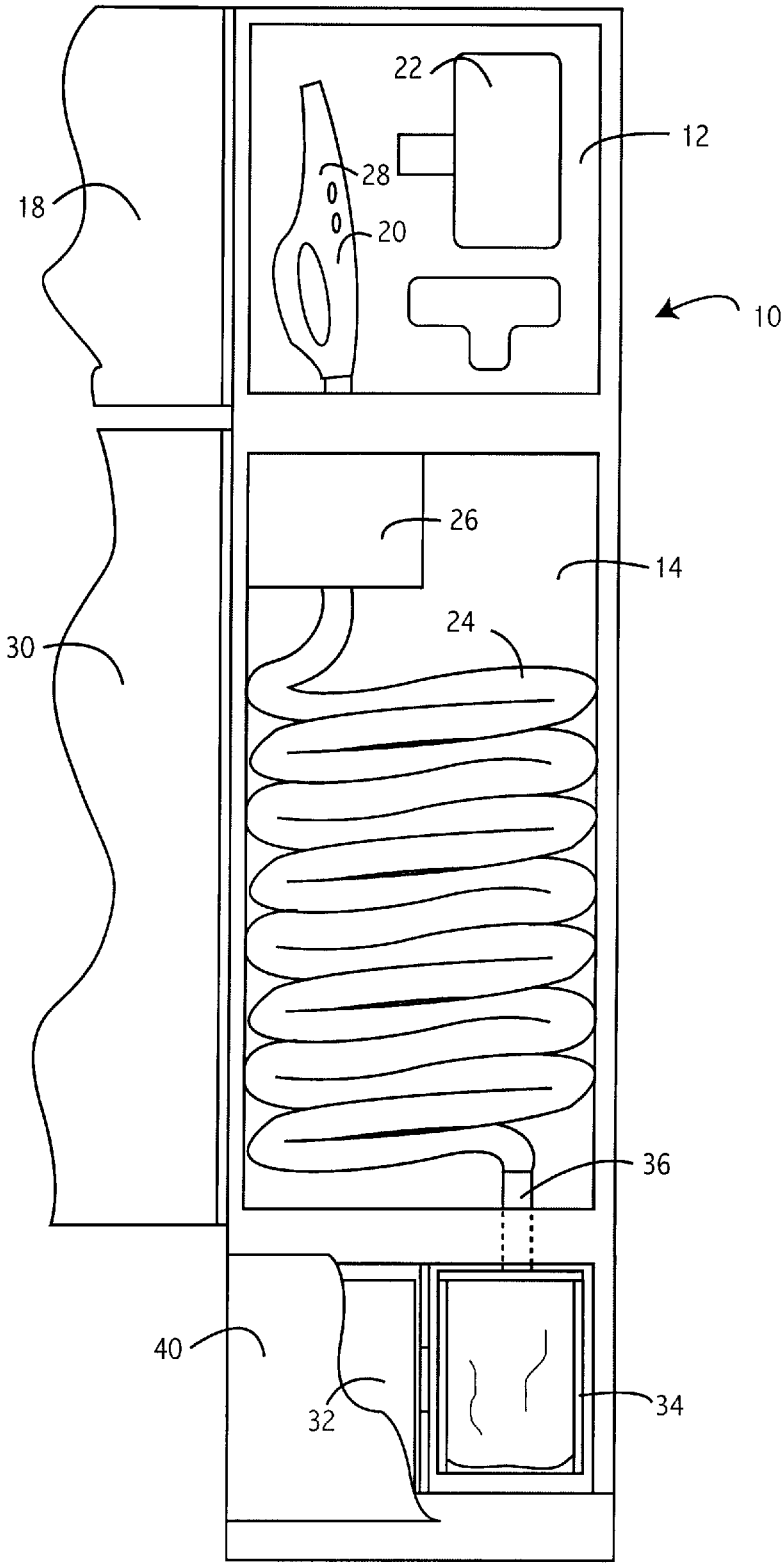
FIG. 1 is a perspective front view of an in-wall vacuum cleaner with the upper door opened to show the interior of the hose and hose accessory compartments, and a part of the door over the vacuum clean bag and vacuum source compartments cut away.

FIG. 1 illustrates an in-wall vacuum cleaner, generally 10, that includes the vacuum cleaner bag holder assembly of the present invention. It will be understood that the assembly can be used with other stationary vacuum cleaners, and that its use with an in-wall vacuum cleaner is for the purpose of illustration. Vacuum cleaner 10 includes an upper or attachment compartment 12, a middle or hose storage compartment 14, and a lower or vacuum source compartment 16.

Attachment compartment 12, covered by a hinged door 18, is adapted to store the handle 20 and a plurality of attachments 22 for convenient access by the user. Handle 20 is attached to the distal end of hose 24 that is stored in hose storage compartment 14. Hose 24 extends through a reversible drive 26 that is controlled by switches 28 on handle 20, and is adapted to extend and retract hose 24 from compartment 14. Hose storage compartment 14 is covered by hinged door 30.

Lower or vacuum source compartment 16 houses a vacuum source 32, which may be an electric motor with a suction fan, and vacuum bag holder 34 in communication with vacuum source 32 through opening 33. Hose conduit 36 extends between hose storage compartment 14 into vacuum source compartment 16. The end of hose conduit 36 within compartment 14 is attached to the proximal end of hose 24, while the other end of conduit 36 projects inwardly to a free end within compartment 16 through top or conduit connector wall 38. It will be understood that in other embodiments, conduit connector wall 38 may serve as a side wall of compartment 16, instead of the top wall. Compartment 16 is covered by hinged door 40.

Figure 2:
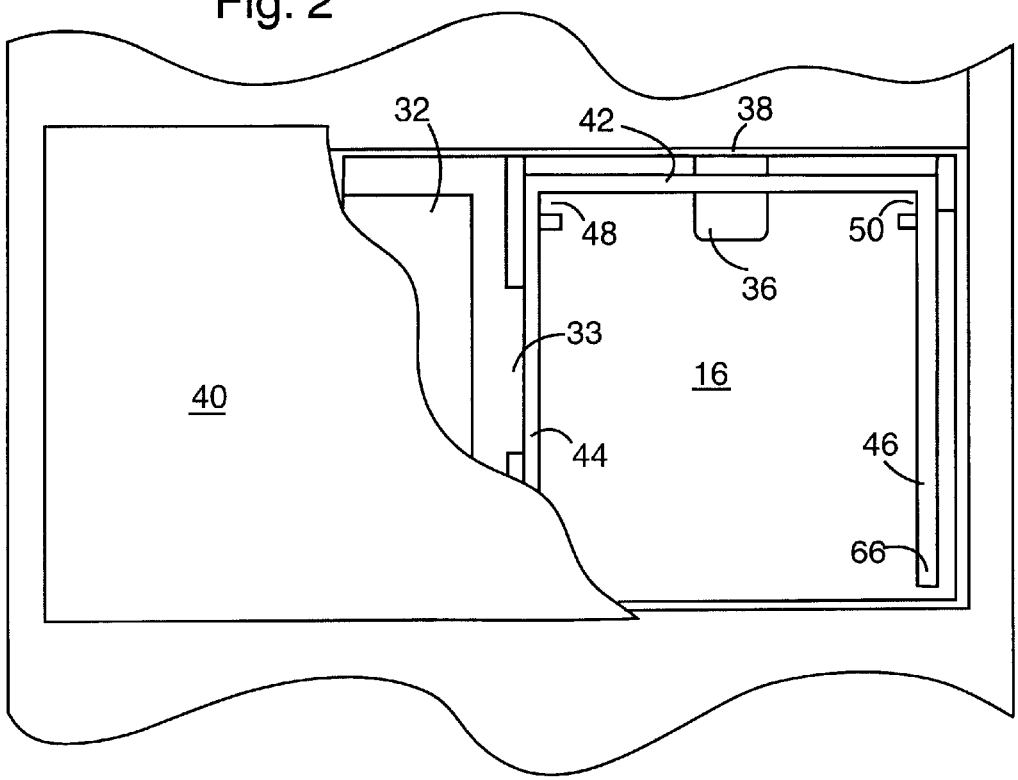
FIG. 2 is a front view of the vacuum cleaner bag mounting assembly with a part of the door cut away and no bag installed.
Figure 3:
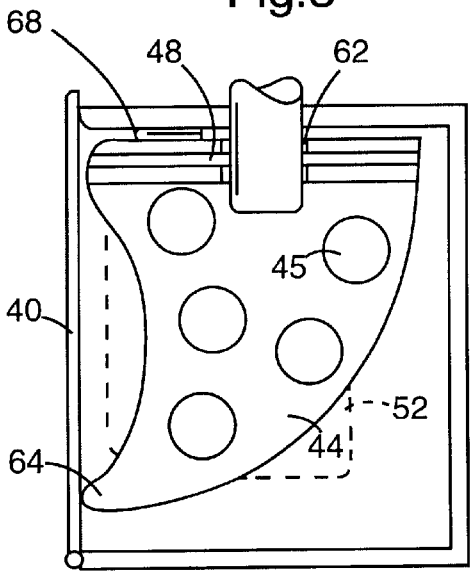
FIG. 3 is sectional side view of the vacuum cleaner bag compartment, with the door closed and the bag in the closed position.
Figure 4:
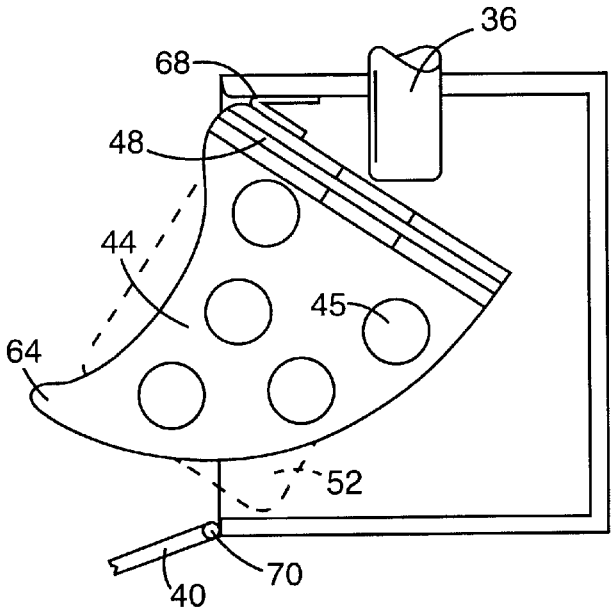
FIG. 4 is a sectional side view of the vacuum cleaner bag compartment, with the door opened and the bag in the open position.
Figure 5:
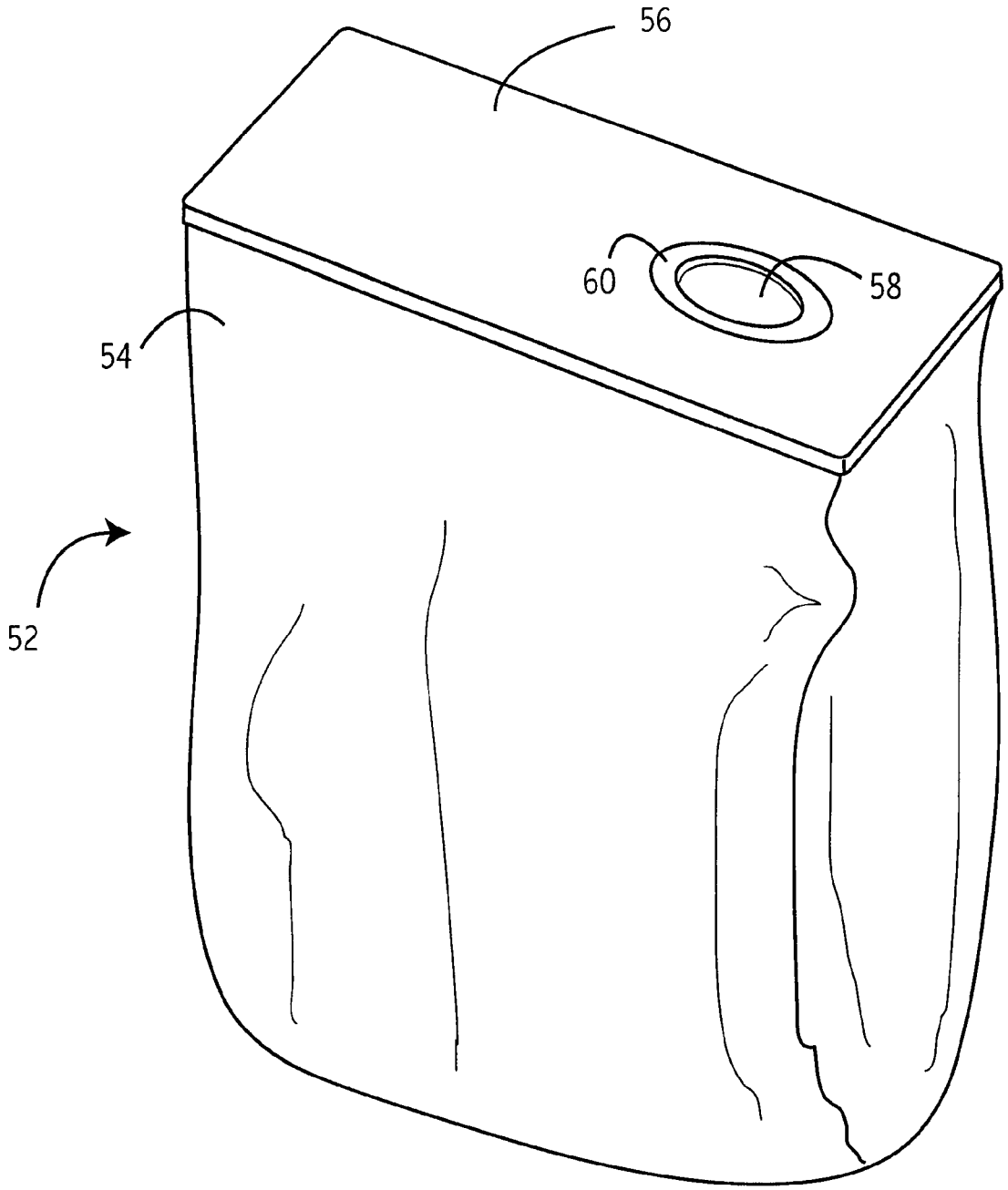
FIG. 5 is a perspective view of a disposable vacuum cleaner bag.

Vacuum bag holder 34, best illustrated in FIGS. 2, 3 and 4, is comprised of a bag attachment wall, shown in the preferred embodiment as upper wall 42, and spaced, parallel bag protector walls, shown in the preferred embodiment as side walls 44 and 46, that extend from the side edges of wall 42. Side walls 44 and 46 may include openings 45 to improve air circulation. The front or outer edge of wall 42 is hinged to the front or outer edge of conduit connector wall 38, permitting wall 42 to pivot between a closed position adjacent and parallel to connector wall 38 when bag holder 34 is in the closed position, and away from connector wall 38 when holder 34 is in the open position. The inner faces of side walls 44 and 46 include bag receiving slots 48 and 50 adjacent and parallel to the lower or inner surface of wall 42.

Bag holder 34 is adapted to receive a disposable debris collector 52 comprised of a open-mouth bag 54 formed of a porous, flexible material, such as paper or a nonwoven fabric, with a cover 56 extending across and sealed to the mouth of bag 54. Cover 56, which may be of cardboard or other disposable material, has parallel side edges, a front edge, and a rear edge, and a conduit receiving opening 58. Opening 58 is surrounded by an annular sealing member 60, which is formed of a flexible, disposable elastomeric material, such as plastic.

Side walls 44 and 46 are spaced at a distance approximately equal to the width of cover 52, and slots 48 and 50, which may be discontinuous slots, have a width approximately equal to the thickness of cover 56. Thus, cover 56 can be slid within slots 48 and 50 to an inserted position beneath upper wall 42. When in the inserted position, conduit receiving opening 58 is aligned with opening 62 in upper wall 42, so that the distal end of conduit 36 can be inserted through opening 62 and 58 into bag 54.

The front edges of side walls 44 and 46 include door engaging projections 64 and 66, respectively, that are adapted to contact the inner face of door 40 when door 40 is moved toward its closed position. Projections 64 and 66 are generally aligned within a plane with the front edges of compartment 16 when door 40 is in a closed position, thereby moving holder 34 to, and restraining holder 34 in, the closed position, when door 40 is pivoted to the closed position.

When door 40 is opened, thereby permitting projections 64 and 66 to move outwardly, holder 34 is pivoted to its open position by spring 68. It will be understood that spring 68 may be located in different positions from that shown in the illustrations, e.g., within hinge 70, which connects upper wall 42 to conduit connector wall 38.

In order to insert disposable collector 52 into bag holder 34, the user opens door 40, thereby allowing holder 34 to pivot to its open position under the force of spring 68. Collector 52 is then inserted into holder 34 by sliding the side edges of bag cover 56 along slots 48 and 50 until cover 56 is fully inserted beneath upper wall 42, and bag 54 is between side walls 44 and 46.

Door 40 is then pivoted to the closed position, with the inner face of door 40 engaging projections 64 and 66, and pivoting holder 34 to its closed position. As holder 34 is moved to the closed position, upper wall 42 is moved to a parallel position against conduit connector wall 38, pushing openings 58 and 62 around conduit 36, so that annular sealing member 60 forms an airtight seal with the outer surface of conduit 36, and the distal end of conduit 36 projects into bag 54.

When collector 52 is to be removed, the user simply opens door 40, which again moves holder 34 to the open position. As holder 34 pivots to the open position, collector 52 is pulled away from conduit 36. Thus, the user can simply pull full collector 52 from holder 34 and insert a new collector, without the need to reach within compartment 16 to separate collector 52 from conduit 36, thereby reducing the inconvenience of bag changing and the risk of debris spillage.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A vacuum cleaner bag mounting assembly for a stationary vacuum cleaner comprising:

a) a compartment having an upper conduit connector wall and a front access opening with an upper edge and a lower edge;

b) a hose connection conduit extending into said compartment through said connector wall, said conduit having a distal end within said compartment and a proximal end outside of said compartment adapted to be connected to a vacuum cleaner hose;

c) a debris collection bag holder having front edges with projections, said bag holder being pivotally mounted at said upper edge and being pivotal between a closed position within said compartment and an open position extending outwardly through said access opening, said holder being adapted to hold a debris bag having a conduit receiving opening that is inserted over said conduit distal end when said holder is moved to the closed position;

d) a spring urging said bag holder to its open position; and e) a door pivotally attached at said lower edge and having an open position and a closed position, said door having an inner face engaging said holder projections when said door is moved from said open position to said closed position, to move said bag holder from its open position to its closed position, and to maintain said holder in the closed position when said door is in the closed position.

2. The assembly of claim 1, wherein said bag holder includes a bag attachment wall with an inner surface and side edges, and spaced parallel side walls extending downwardly from said attachment wall side edges, said holder including bag attachment slots beneath said attachment wall inner surface.

3. The assembly of claim 1, wherein said compartment includes an opening in communication with a remote vacuum source.

4. The assembly of claim 1, wherein said holder is hinged at said upper edge by said spring.

5. The assembly of claim 1, wherein said bag holder includes spaced, perforated, parallel side walls.

6. A stationary vacuum cleaner comprising:

a) a hose storage compartment in communication with a remote vacuum source;

b) a vacuum cleaner hose having a proximal end, and a stored position within said storage compartment;

c) a bag compartment having an upper conduit connector wall and a front access opening with an upper edge and a lower edge;

d) a hose connection conduit extending into said bag compartment through said connector wall, said conduit having a distal end within said bag compartment and a proximal end outside of said bag compartment adapted to be connected to said vacuum cleaner hose;

e) a debris collection bag holder including a collector attachment wall having an opening through which said conduit extends when said holder is in the closed position, and a bag attachment means for releasibly securing the collection bag to said attachment wall, said bag holder being pivotally mounted at said upper edge and being pivotal between a closed position within said bag compartment and an open position extending outwardly through said access opening, said holder being adapted to hold a debris bag having a conduit receiving opening that is inserted over said conduit distal end when said holder is moved to the closed position;

f) a spring urging said bag holder to its open position; and g) a door pivotally attached at said lower edge and having an open position and a closed position, said door engaging said holder when moved from said open position to said closed position, to move said bag holder from its open position to its closed position, and to maintain said holder in the closed position when said door is in the closed position.

7. The stationary vacuum cleaner of claim 6, further including a drive means for moving said hose to and from said stored position.

8. The stationary vacuum cleaner of claim 6, further including a handle storage compartment, said hose having a distal end connected to a handle stored in said handle storage compartment when said hose is in said stored position.

9. The assembly of claim 6, wherein said bag holder is comprised of a bag attachment wall with an inner surface and side edges, and spaced parallel side walls extending downwardly from said attachment wall side edges, said holder including bag attachment slots beneath said attachment wall inner surface.

10. The assembly of claim 6, wherein said holder includes front edges with projections, and said door includes an inner face engaging said projections when said door is moved from said open position to said closed position, said projections engaging said door inner face when said door is in the closed position to maintain said holder in the closed position.

11. The assembly of claim 6, wherein said holder is hinged at said upper edge by said spring.

12. The assembly of claim 6, wherein said bag holder includes spaced, perforated, parallel side walls.

* * * * *